US006089240A

United States Patent [19]

Chang

[11] Patent Number: 6,089,240

[45] Date of Patent: Jul. 18, 2000

[54] HAIR GRIP DEVICE

[76] Inventor: Wen-Hsivng Chang, 45, Huan Kung Rd., Yung Kang Industrial Park, Yung Kang, Tainan Hsian, Taiwan

[21] Appl. No.: 09/217,521

[22] Filed: Dec. 21, 1998

[51] Int. Cl.[7] ..... A45D 8/04; A45D 8/00; A45D 8/20; A45D 8/22

[52] U.S. Cl. ..... 132/273; 132/276; 132/277; 132/278

[58] Field of Search ..... 132/273, 275, 132/276, 277, 278, 279; D28/39, 40, 41, 42, 43

[56] References Cited

U.S. PATENT DOCUMENTS 5,365,955 11/1994 Desgroux et al. ..... 132/279
5,402,805 4/1995 Barinas ..... 132/279
5,477,870 12/1995 Menaged ..... 132/279
5,535,765 7/1996 Takashima ..... 132/273

*Primary Examiner*—John J. Wilson
*Assistant Examiner*—Robyn K Doan
*Attorney, Agent, or Firm*—Alan Kamrath; Oppenheimer, Wolff & Donnelly, LLP

[57] ABSTRACT

A hair grip device has a first decoration clamp device and a second decoration clamp device connected to the first decoration clamp device. The first decoration clamp device has a distal click flange, and two first elastic plates. The second decoration clamp device has a push plate, a click portion, and two second elastic plates. The distal click flange of the first decoration clamp device engages with the click portion of the second decoration clamp device. The click portion of the second decoration clamp device has a plurality of grooves. Each of the second elastic plates has a hook end portion.

8 Claims, 5 Drawing Sheets

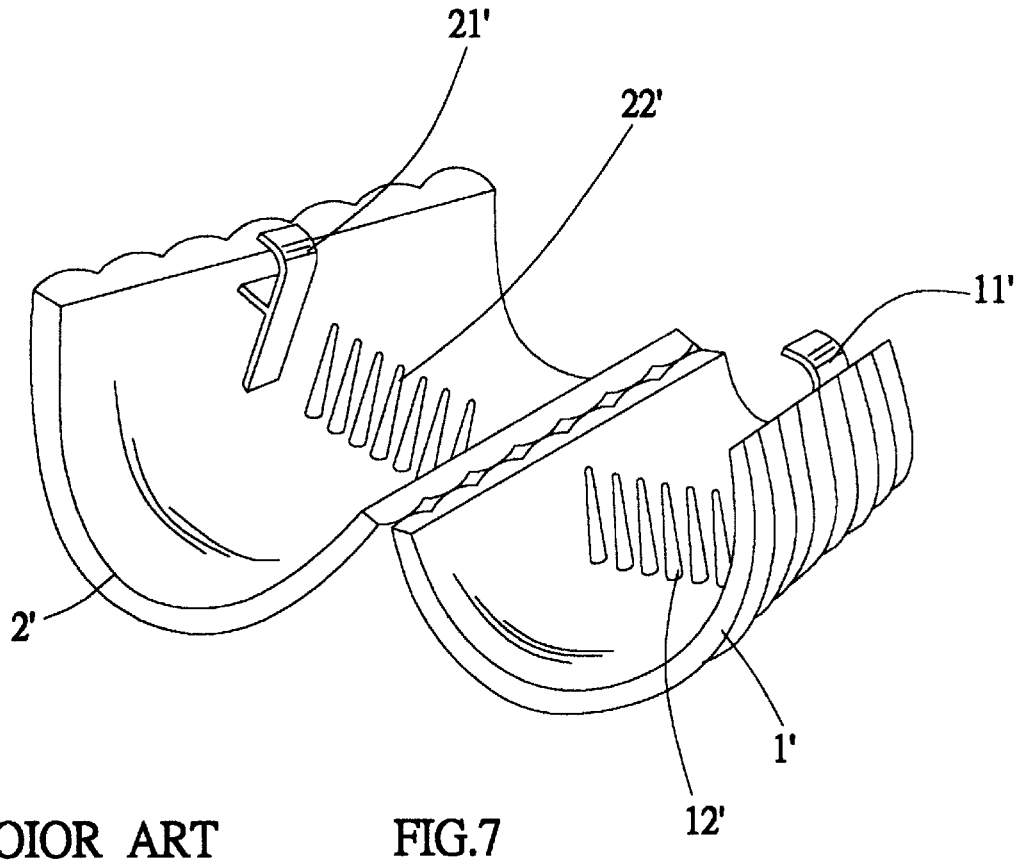
PROIOR ART FIG.7
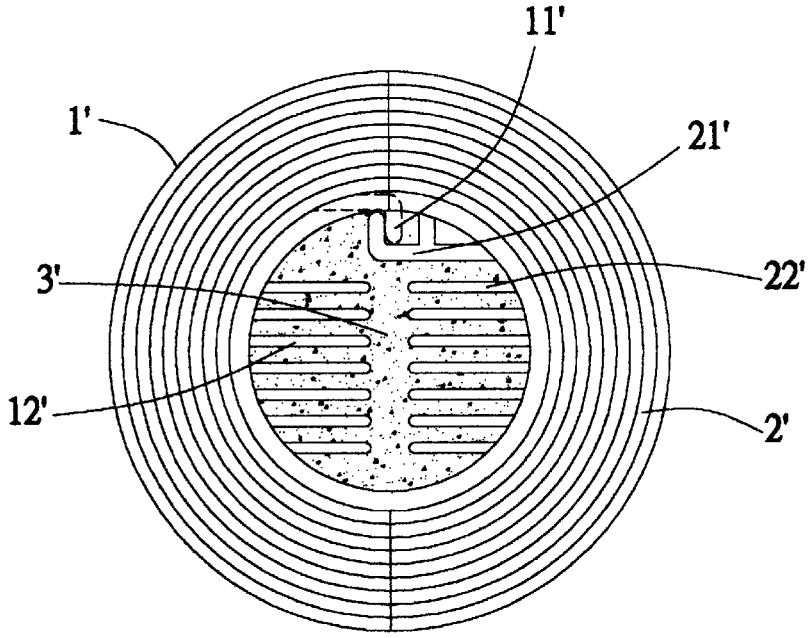
PROIOR ART FIG.8

HAIR GRIP DEVICE

BACKGROUND OF THE INVENTION

The present invention relates to a hair grip device. More particularly, the present invention relates to a hair grip device which can fasten a strand of hair stably.

Referring to FIGS. 7 and 8, a conventional hair grip device comprises a first clamp device 1' and a second clamp device 2'. The first clamp device 1' has a male click 11' and a plurality of inner teeth 12'. The second clamp device 2' has a female click 21' and a plurality of inner serrations 22'. The male click 11' engages with the female click 21'. The inner interior of the conventional hair grip device cannot be adjusted. The conventional hair grip device can clamp a strand of hair. However, the conventional hair grip device cannot fasten a strand of hair stably. Thus the conventional hair grip device will be released from the strand of hair easily.

SUMMARY OF THE INVENTION

An object of the present invention is to provide a hair grip device which can fasten a strand of hair stably.

Accordingly, a hair grip device comprises a first decoration clamp device and a second decoration clamp device connected to the first decoration clamp device. The first decoration clamp device has a distal click flange, and two first elastic plates. Each of the first elastic plates has a corrugation. The second decoration clamp device has a push plate, a click portion, and two second elastic plates. Each of the second elastic plates has a corrugation. The distal click flange of the first decoration clamp device engages with the click portion of the second decoration clamp device. The click portion of the second decoration clamp device has a plurality of grooves to receive the distal click flange of the first decoration clamp device. Each of the second elastic plates has a hook end portion.

BRIEF DESCRIPTION OF THE DRAWINGS

FIG. 7 is a perspective exploded view of a hair grip device of the prior art; and FIG. 8 is a schematic view illustrating an application of a hair grip device of the prior art.

DETAILED DESCRIPTION OF THE INVENTION

Figure 1:
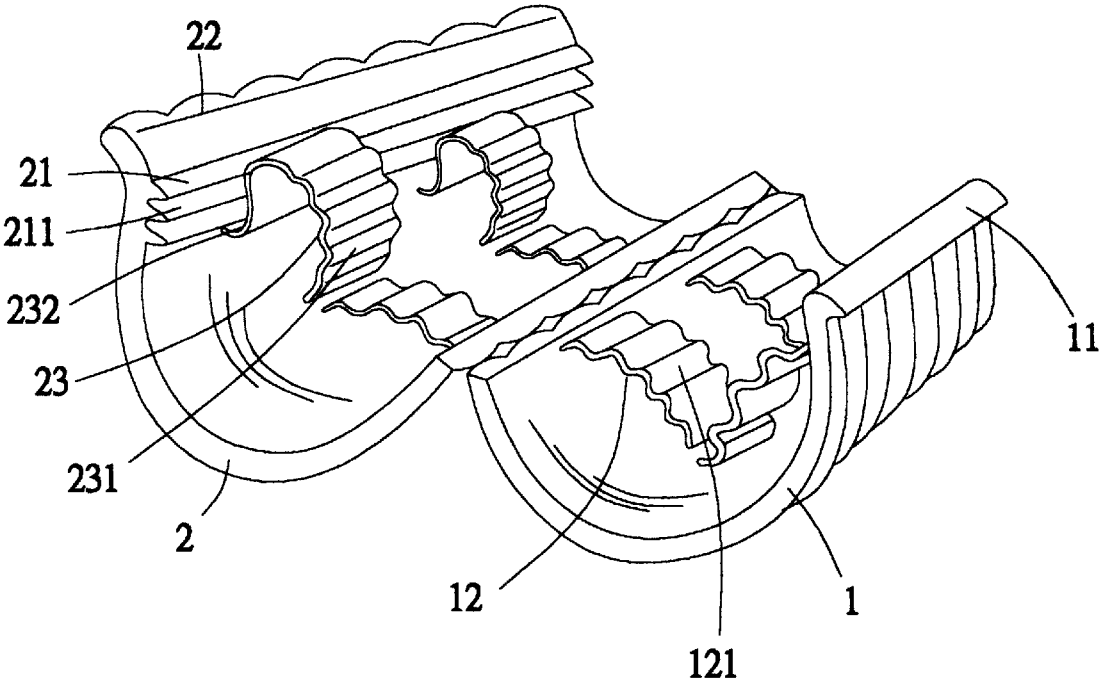
FIG. 1 is a perspective exploded view of a hair grip device of a preferred embodiment in accordance with the present invention.
Figure 2:
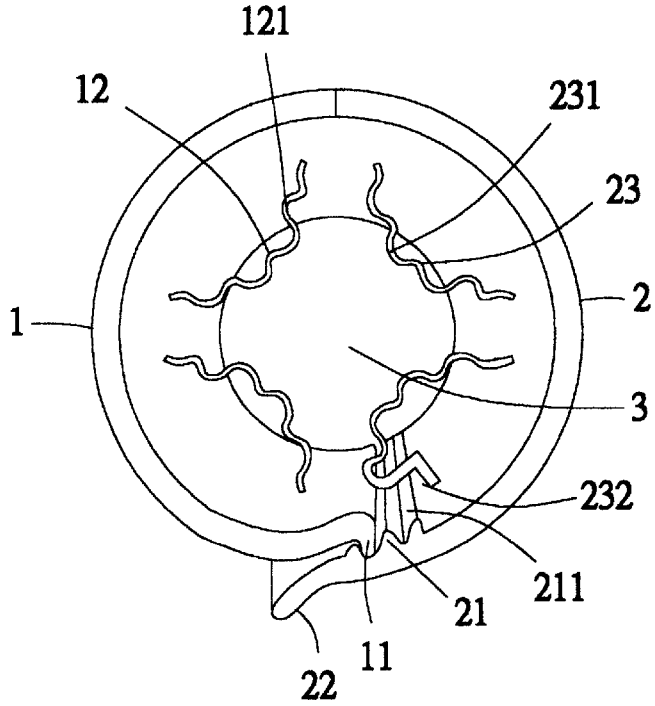
FIG. 2 is a schematic view illustrating a closing of a hair grip device of a preferred embodiment in accordance with the present invention.
Figure 3:
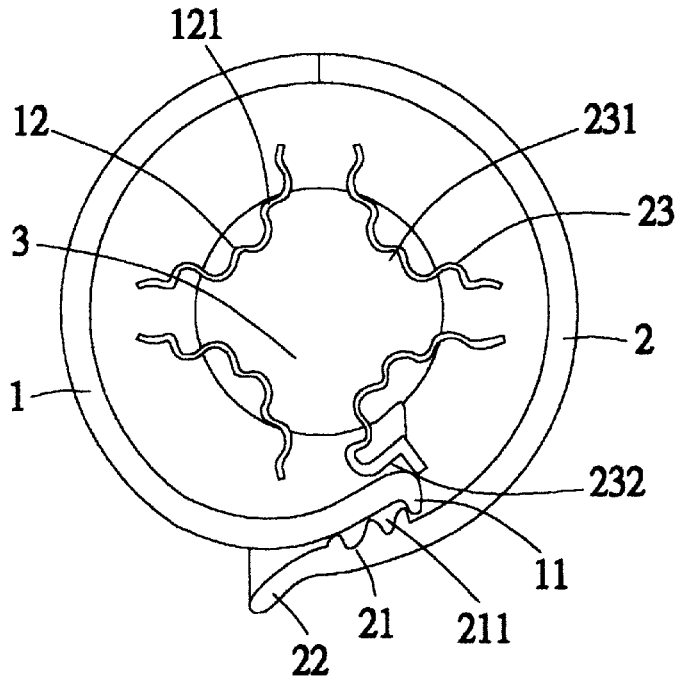
FIG. 3 is another schematic view illustrating a closing of a hair grip device of a preferred embodiment in accordance with the present invention.
Figure 4:
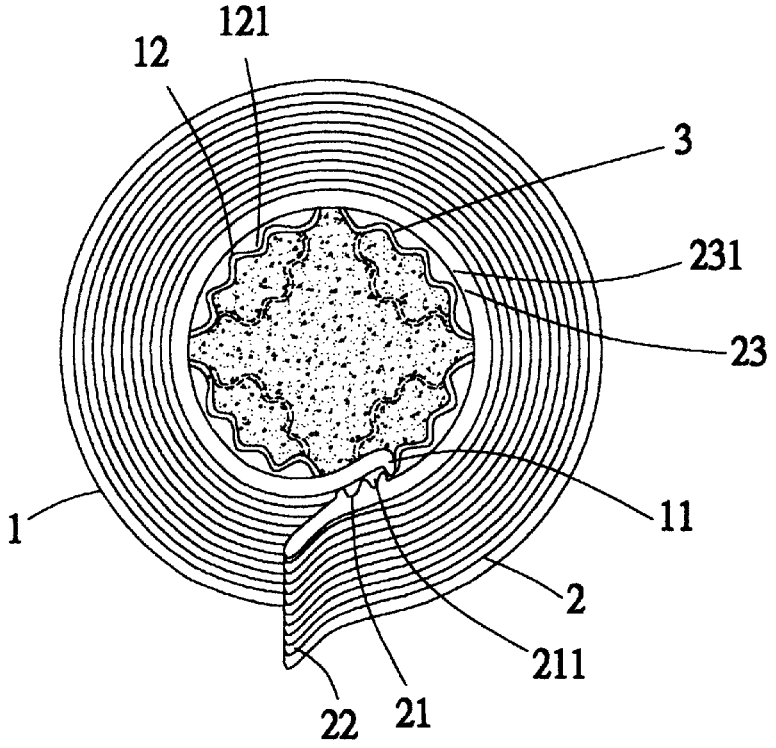
FIG. 4 is a schematic view illustrating an application of a hair grip device of a preferred embodiment in accordance with the present invention.
Figure 5:
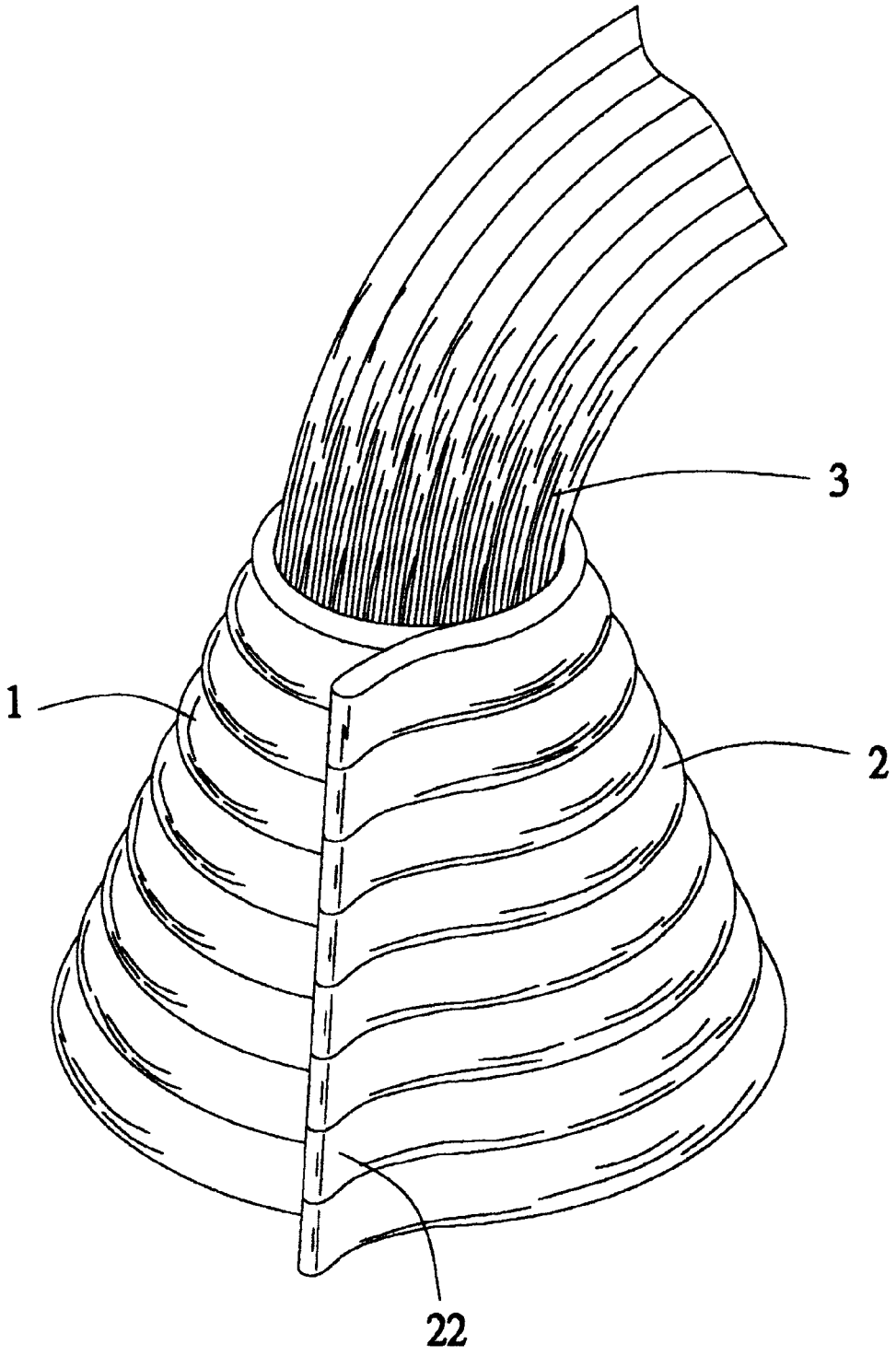
FIG. 5 is another schematic view illustrating an application of a hair grip device of a preferred embodiment in accordance with the present invention.
Figure 6:
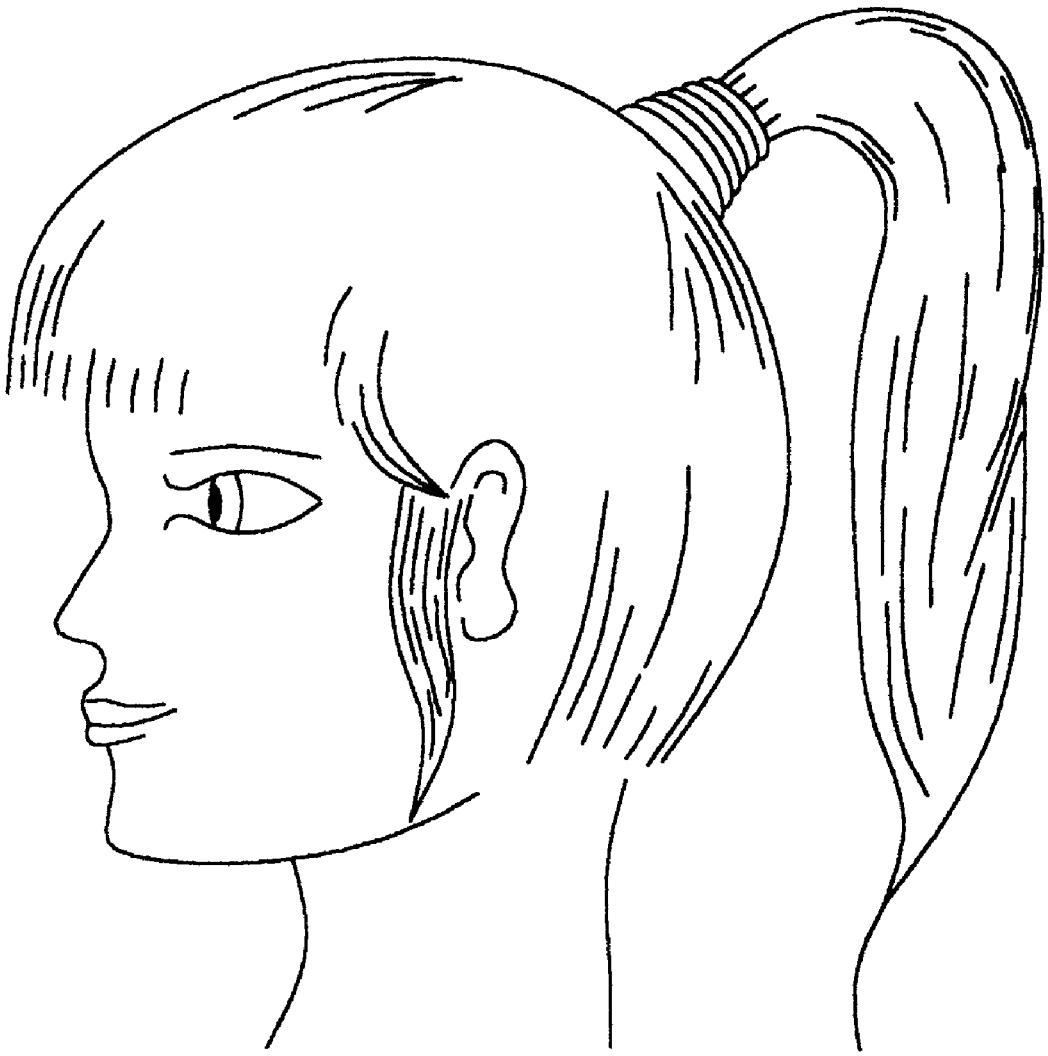
FIG. 6 is a third schematic view illustrating an application of a hair grip device of a preferred embodiment in accordance with the present invention.

Referring to FIGS. 1 to 6, a hair grip device comprises a first decoration clamp device 1 and a second decoration clamp device 2 connected to the first decoration clamp device 1.

The first decoration clamp device 1 has a distal click flange 11, and two first elastic plates 12. Each of the first elastic plates 12 has a corrugation 121.

The second decoration clamp device 2 has a push plate 22, a click portion 21, and two second elastic plates 23. Each of the second elastic plates 23 has a corrugation 231.

The distal click flange 11 of the first decoration clamp device 1 engages with the click portion 21 of the second decoration clamp device 2.

The click portion 21 of the second decoration clamp device 2 has a plurality of grooves 211 to receive the distal click flange 11 of the first decoration clamp device 1.

Each of the second elastic plates 23 has a hook end portion 232.

Referring to FIGS. 2 to 6 again, an inner interior 3 is defined by the first decoration clamp device 1 and the second decoration clamp device 2 to receive a strand of hair of the user. The user can push the push plate 22 to adjust the diameter of the inner interior 3.

Since the first elastic plates 12 cooperate with the second elastic plates 23 to confine the strand of hair of the user, the hair grip device of the present invention can fasten the strand of hair of the user stably.

The user can push the push plate 22 to adjust the diameter of the inner interior 3.

The push plate 22 facilitates the user to operate the hair grip device of the present invention.

The invention is not limited to the above embodiment but various modification thereof may be made. Further, various changes in form and detail may be made without departing from the scope of the invention.

I claim:

1. A hair grip device comprises:

a first decoration clamp device and a second decoration clamp device connected to the first decoration clamp device, with the first decoration clamp device having a distal click flange and two first elastic plates, with the second decoration clamp device having a push plate, a click portion, and two second elastic plates, with the distal click flange of the first decoration clamp device engaging with the click portion of the second decoration clamp device and with the first elastic plates cooperating with the second elastic plates to confine a strand of hair of a user.

2. A hair grip device as claimed in claim 1, wherein each of the second elastic plates has a hook end portion.

3. A hair grip device as claimed in claim 1, wherein each of the elastic plates are corrugated.

4. A hair grip device comprises:

a first decoration clamp device and a second decoration clamp device connected to the first decoration clamp device, with the first decoration clamp device having a distal click flange and two first elastic plastic plates, with the second decoration clamp device having a push plate, a click portion and two second elastic plates, with the distal click flange of the first decoration clamp device engaging with the click portion of the second decoration clamp device and with the first elastic plates cooperating with the second elastic plates to confine a strand of hair of a user and, wherein each of the first elastic plates has opposite end portions embedded in the first decoration clamp device and each of the second elastic plates has opposite end portions embedded in the second decoration clamp device.

5. A hair grip device as claimed in claim 4, wherein each of the second elastic plates has a hook end portion.

6. A hair grip device as claimed in claim 4, wherein each of the elastic plates are corrugated.

7. A hair grip device as claimed in claim 4, wherein the click portion of the second decoration clamp device has a plurality of grooves, with the click flange of the first decoration clamp device being received in one of the plurality of grooves to adjust an inner interior defined by the first and second decoration clamp devices.

8. A hair grip device as claimed in claim 7, wherein each of the elastic plates are corrugated.

* * * * *